US007988144B2

(12) United States Patent
Coret et al.

(10) Patent No.: US 7,988,144 B2
(45) Date of Patent: Aug. 2, 2011

(54) DEVICE FOR SELECTING MAILPIECES WITH TWO COOPERATING COMB-SHAPED GUIDES

(75) Inventors: Francis Coret, Gournay sur Marne (FR); Yannick Claris, Fontenay aux Roses (FR); Christophe Peynet, L'Hay les Roses (FR)

(73) Assignee: Neopost Technologies, Bagneux (FR)

( * ) Notice: Subject to any disclaimer, the term of this patent is extended or adjusted under 35 U.S.C. 154(b) by 92 days.

(21) Appl. No.: 12/353,782

(22) Filed: Jan. 14, 2009

(65) Prior Publication Data

US 2009/0189333 A1 Jul. 30, 2009

(30) Foreign Application Priority Data

Jan. 30, 2008 (FR) ..... 08 50584

(51) Int. Cl.
*B65H 3/56* (2006.01)

(52) U.S. Cl. ..... 271/121

(58) Field of Classification Search ..... None
See application file for complete search history.

(56) References Cited

U.S. PATENT DOCUMENTS 3,219,339 A 11/1965 Gutierrez et al.
3,737,158 A * 6/1973 Beery et al. ..... 271/117
4,330,115 A * 5/1982 Mouri et al. ..... 271/124
4,674,737 A * 6/1987 Murayoshi ..... 271/124
4,718,809 A * 1/1988 Krasuski et al. ..... 271/121
4,909,499 A 3/1990 O'Brien et al.
5,431,385 A * 7/1995 Holbrook ..... 271/122
5,718,425 A * 2/1998 Veigl ..... 271/121
6,276,679 B1 * 8/2001 Joyce et al. ..... 271/124
6,971,645 B2 * 12/2005 Coret et al. ..... 271/138
7,703,769 B2 * 4/2010 Schwarzbauer ..... 271/275

FOREIGN PATENT DOCUMENTS

EP 0 195 348 A1 9/1986
GB 2 029 377 A 3/1980

* cited by examiner

*Primary Examiner* — Gerald W McClain

(74) *Attorney, Agent, or Firm* — Sughrue Mion, PLLC

(57) ABSTRACT

A mailpiece selector device for separating mailpieces one-by-one from a stack of mailpieces and for transporting them downstream, the mailpiece selector device having a first guide followed by a second guide, both of which guides co-operate with a plurality of opposite selector rollers to select the mailpieces one-by-one and to transport them downstream, the first guide being able to pivot about a first pivot axis in opposition to first resilient returner, the second pivot axis being offset upstream relative to the first pivot axis, and the first and second guides having a driver for making it possible, above a predetermined mailpiece thickness range, for the second guide to pivot automatically when the first guide pivots.

8 Claims, 2 Drawing Sheets

DEVICE FOR SELECTING MAILPIECES WITH TWO COOPERATING COMB-SHAPED GUIDES

TECHNICAL FIELD

The present invention relates to the field of mail handling, and it relates more particularly to a device for selecting mailpieces that is implemented in an automatic feed module or "feeder" of a franking machine or "postage meter" for franking mailpieces.

PRIOR ART

Conventionally, a franking machine must be adapted to receive various types of mailpiece, such as documents, letters, or envelopes of greater or lesser thickness, typically lying in the range 0.1 millimeters (mm) to 16 mm. To this end, on the upstream side, it is often provided with an automatic feed module making it possible, in particular, to convey said mailpieces at various speeds. That automatic feed module usually includes means for receiving/stacking, selecting, transporting, and possibly closing said mailpieces.

European Patent EP 0 856 483, granted to the Applicant, shows an example of such an automatic feeder including a selector module adapted to passing mailpieces of various thicknesses, however the selection quality of that module is highly dependent on the force applied by the single guide to the mailpiece. For mailpieces of small thickness, typically of thickness less than 6 mm, that force must be large in order to limit the number of double passes, i.e. the number of times two envelopes pass through together towards the franking machine, whereas said force can be small for mailpieces of larger thickness. Such double passes are highly detrimental because they give rise not only to one of the two mailpieces being over-invoiced (because two mailpieces are weighed instead of one), but also to the upper mailpiece not being franked and to the lower mailpiece not being closed. Unfortunately, since the guide is pressed against the mailpiece by a compression spring in order to avoid such double passes, mailpieces of large thickness, and more particularly large-thickness mailpieces having windows, might be damaged or torn.

OBJECT AND DEFINITION OF THE INVENTION

An object of the present invention is to mitigate the drawbacks resulting from two envelopes passing through together by proposing a mailpiece selector device for a franking machine feeder that can limit such double passes to at the most 1 in 1000.

This object is achieved by a mailpiece selector device for separating mailpieces one-by-one from a stack of mailpieces and for transporting them downstream, wherein said mailpiece selector device comprises a first guide followed by a second guide, both of which guides co-operate with a plurality of opposite selector rollers to select said mailpieces one-by-one and to transport them downstream, said first guide being able to pivot about a first pivot axis in opposition to first resilient return means, and said second guide being able to pivot about a second pivot axis in opposition to second resilient return means, said second pivot axis being offset upstream relative to said first pivot axis, and said first and second guides having drive means for making it possible, above a predetermined mailpiece thickness range, for said second guide to pivot automatically when said first guide pivots.

In a preferred embodiment, said drive means comprise at least one bearing surface secured to or integral with said first guide and designed to co-operate with at least one abutment on said second guide, so that, as a mailpiece having a thickness lying in a predetermined mailpiece thickness range passes through, said first guide pivoting causes said second guide to pivot.

By means of this specific structure, it is possible to cause the second guide to move out of the way for envelope thicknesses for which said second guide has no effect (thick envelopes) or to cause it to be raised slightly for envelope thicknesses at which it might damage the more fragile envelopes (standard envelopes). It thus becomes possible to process all types of envelope, and the quality of selection of thin envelopes is improved.

Advantageously, the offset of said pivot axes is adapted so that, below said predetermined mailpiece thickness range, said first guide pivoting does not cause said second guide to pivot at all, and so that, above a predetermined mailpiece thickness range, said first guide pivoting causes said second guide to be retracted out of the mailpiece transport path.

Preferably, said first guide is comb-shaped, each of the teeth of the comb having an elastomer blade or a ceramic finger fastened to it.

The present invention also relates to a mailpiece feeder for a franking machine, which feeder includes the above-mentioned mailpiece selection device.

BRIEF DESCRIPTION OF THE DRAWINGS

Other characteristics and advantages of the present invention appear more clearly from the following description given by way of non-limiting indication and with reference to the accompanying drawings, in which.

DETAILED DESCRIPTION OF A PREFERRED EMBODIMENT OF THE INVENTION

An automatic mailpiece feed module conventionally has a feed zone formed essentially by a deck designed to receive a stack of mailpieces and including first transport rollers for driving the mailpieces downstream (and against a referencing wall) at a separation zone having a separator device in which the mailpieces are extracted one by one from the stack of mailpieces. Second transport rollers are, in general, provided at the outlet of said separation zone for the purpose of conveying the mailpieces extracted in this way downstream. Such an automatic feeder is, for example, illustrated in the European patent cited in the introduction to the present application.

Figure 1:
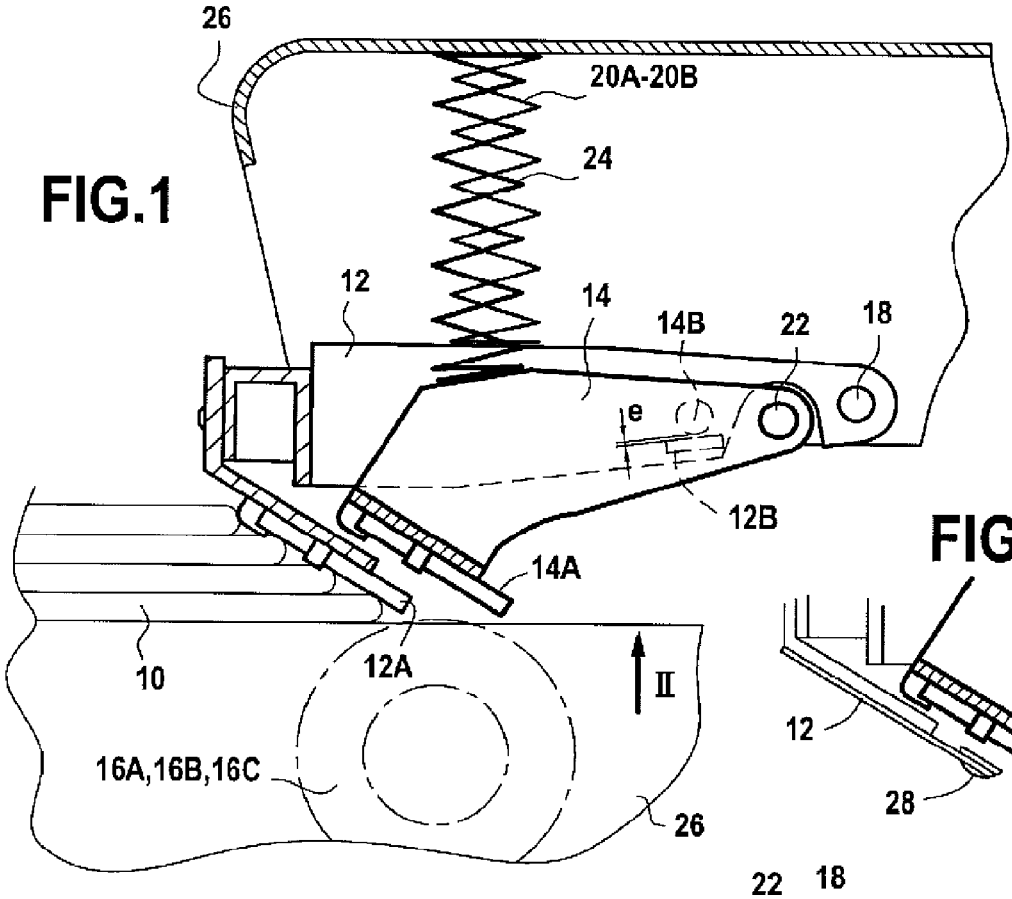
FIG. 1 is a longitudinal section view of a mailpiece selector device of the invention.
Figure 2:
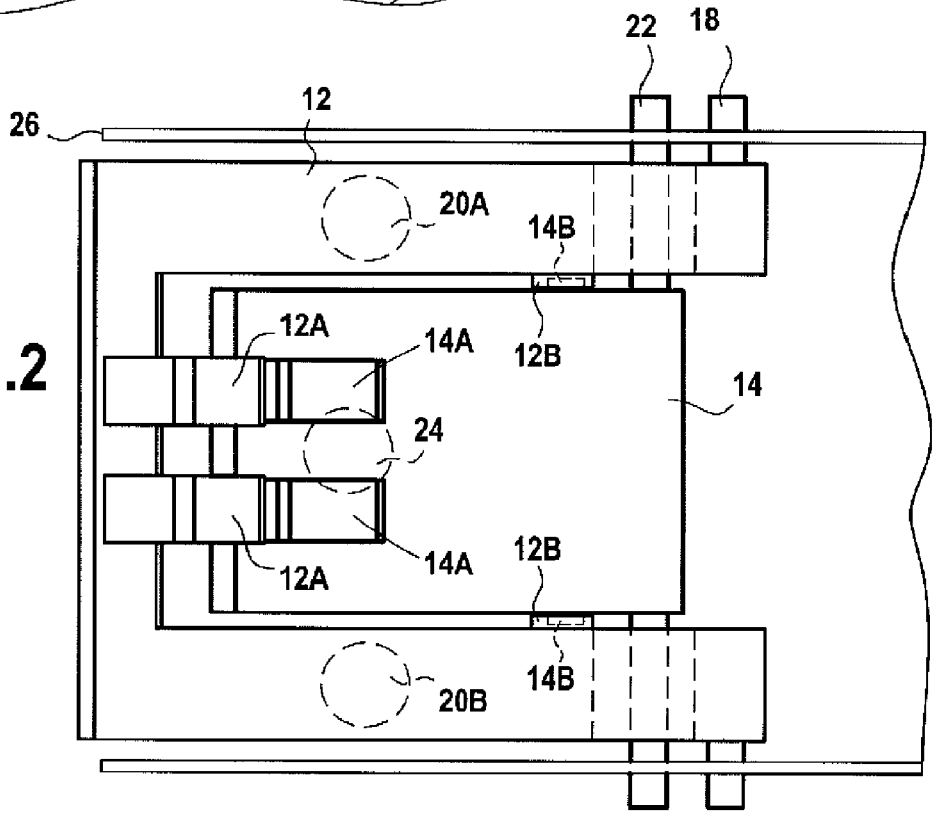
FIG. 2 is a plan view of the selector device of FIG. 1.

FIGS. 1 and 2 show, more precisely, the structure of the mailpiece separator device 10 of the invention, which device essentially comprises a first guide 12 followed by a second guide 14, both of which co-operate with a plurality of opposite selector rollers, e.g. 16A, 16B, 16C, to select a single mailpiece only and to transport it downstream. The first guide is hinged about a first pivot axis 18 and can pivot in opposition to first resilient return means, e.g. at least one compression spring 20A, 20B, as the mailpieces pass over the selector rollers, and the second guide is hinged about a second pivot axis 22 that is offset upstream relative to the first pivot axis 18, and it can pivot similarly in opposition to second resilient return means, e.g. a compression spring 24, as the mailpieces pass over the selector rollers. Each of the two resilient return means is also in abutment against a portion of framework 26 of the selector device. It should be noted that, although, by way of example, reference is made to a compression spring, naturally a traction spring could also be suitable subject to having a different configuration for fastening the spring to the framework.

As is known, the first and second guides 12 14 are not disposed perpendicularly to the transport path of the mailpieces, but rather they are inclined downstream by about 45°. Each of them is comb-shaped and each of its teeth (of which there are two in the example shown) has a blade 12A, 14A made of elastomer fastened to it that has a very high coefficient of friction in order to guarantee the best possible contact with the mailpiece.

Figure 1A:
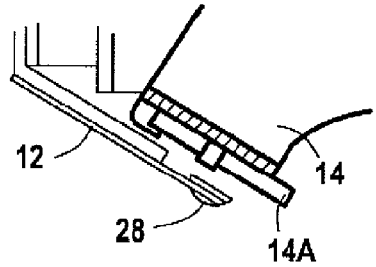
FIG. 1A is a view showing a variant embodiment of the first guide.

In a variant embodiment shown in FIG. 1A, the elastomer blade is replaced with a ceramic finger 28 that, compared with an elastomer blade, offers the advantage of not wearing and of not leaving marks on the mailpieces. Although an elastomer blade offers high performance, it wears relatively rapidly and might cause the more fragile of the mailpieces to be damaged by being creased or by jamming.

Figure 3:
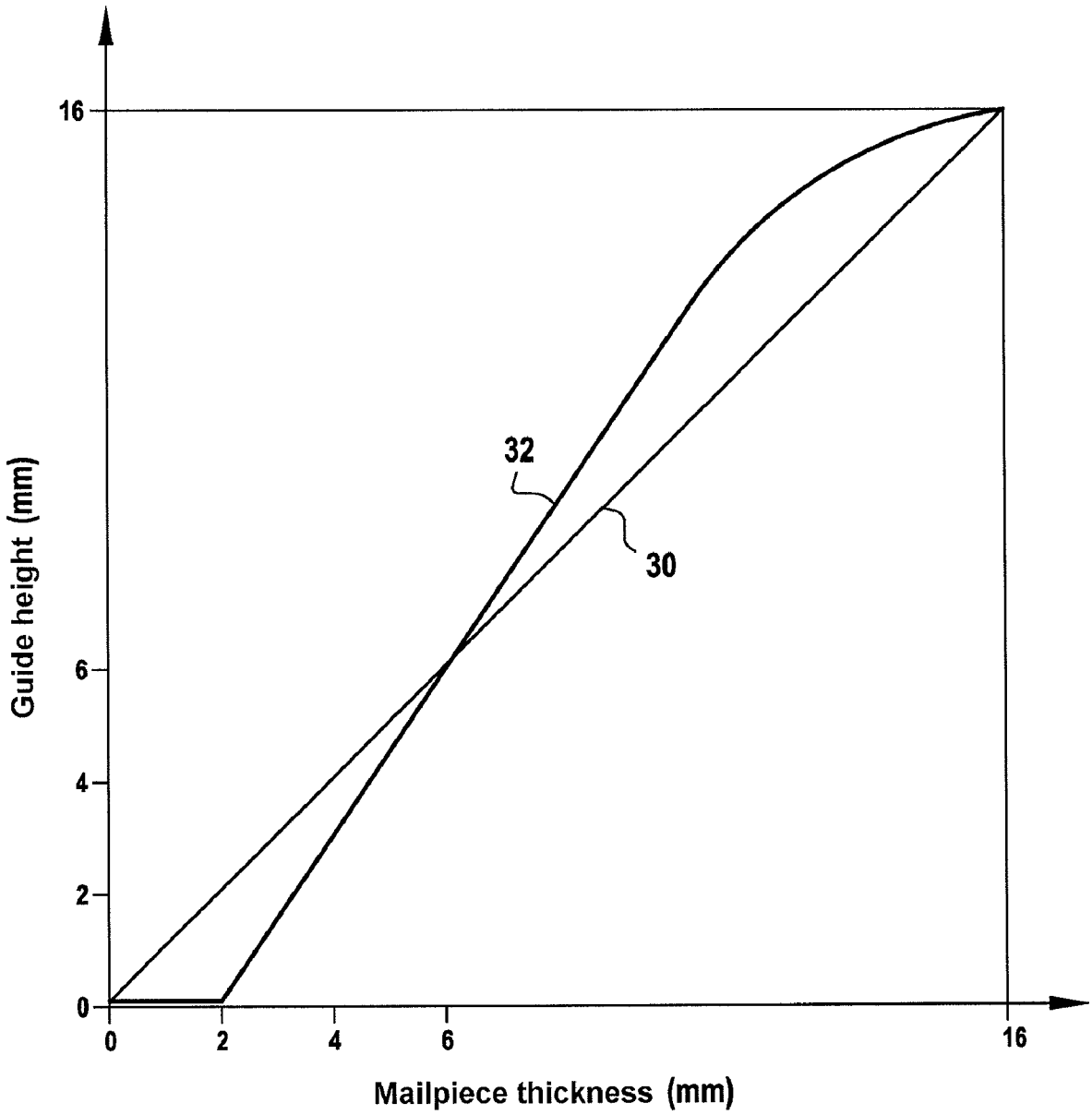
FIG. 3 shows two curves representing movement of the first and second guides depending on mailpiece height.

In accordance with the invention, the two guides move together. More particularly, the first guide is provided with at least one bearing surface 12B designed to co-operate with at least one abutment 14B on the second guide, so that, only above a predetermined mailpiece thickness range defined by the distance e between the abutment and the corresponding bearing surface, movement of the first guide automatically causes the second guide to move progressively. Thus, by means of offsetting the pivot axes 18, 22, by means of the distances between said axes and the contact ends of the guides, and by means of the action of the bearing surface 12B on the abutment 14B, it is possible to obtain the respective joint movements of the first and second guides as shown in FIG. 3, so that the first guide being caused to pivot (curve 30) by a mailpiece having a small thickness, i.e. lying in the range 0 mm to 2 m, does not cause the second guide to be raised (curve 32), whereas the first guide being caused to pivot by a mailpiece having a standard thickness, lying in the range 2 mm to 6 mm, causes the second guide to be raised progressively, and whereas the first guide being caused to pivot by a mailpiece having a thickness greater than 6 mm causes the second guide to be retracted fully so that said second guide is no longer in contact with the mailpiece and thus no longer acts on the selection process.

The selector device of the invention operates as follows. Once the mailpieces to be processed have been placed in bulk on the deck of the feed device, then for mailpieces of small thickness, i.e. of thickness less than 2 mm, most of the selection work is done by the first guide, the second guide, which remains subjected to its return spring 22, catching any double passes if necessary. For mailpieces of standard thickness, i.e. of thickness lying in the range 2 mm to 6 mm, the mailpiece, by raising the first guide, causes the second guide to pivot progressively so that said second guide is raised in part when the mailpiece reaches it, thereby preventing said second guide, on which the compression spring 24 acts, from being worn prematurely by repeated impacts with the mailpieces, to which impacts it is subjected for such mailpieces and for mailpieces of small thickness. The progressive raising also prevents the more fragile mailpieces, such as envelopes having windows, from being creased. In addition, when the mailpiece leaves the first guide, said first guide descending under the action of the first return spring 20*a*, 20*b* has no effect on the selection then performed by the second guide.

Thus, with the present invention, it is possible to process envelopes of various thicknesses without using a specific lever to select a particular operating mode (e.g. for envelopes of thickness greater than 6 mm). In addition, since the second guide no longer suffers wear in the operating mode in which it does not act, i.e. for envelopes of large thickness, or suffers less wear for envelopes of standard thickness, it needs to be replaced much less frequently than in prior art devices, thereby limiting the periods for which the franking machine is unavailable.

What is claimed is:

1. A mailpiece selector device for separating mailpieces one-by-one from a stack of mailpieces and for transporting them downstream, wherein said mailpiece selector device comprises:

a first guide followed by a second guide, the first guide having a downstream end; and a plurality of opposite selector rollers cooperating with said first and second guides to select said mailpieces one-by-one and to transport them downstream, said first guide being adapted to pivot about a first pivot axis in opposition to first resilient return means, said second guide being adapted to pivot about a second pivot axis in opposition to second resilient return means, and said second pivot axis being offset upstream relative to said first pivot axis, and said first and second guides having drive means adapted to automatically pivot said second guide with said first guide when said downstream end of said first guide pivots a distance above a predetermined mailpiece thickness range, wherein said drive means comprise at least one bearing surface secured to or integral with said first guide and facing at a predetermined distance at least one abutment on said second guide, so that, as a mailpiece having a thickness in said predetermined mailpiece thickness range passes through, said first guide pivoting causes said second guide to pivot.

2. A mailpiece feeder for a franking machine, which feeder includes a mailpiece selection device according to claim 1.

3. A mailpiece selector device according to claim 1, wherein the offset of said pivot axes is adapted so that, below said predetermined mailpiece thickness range, said first guide pivoting does not cause said second guide to pivot at all.

4. A mailpiece selector device according to claim 1, wherein the offset of said pivot axes is adapted so that, above a predetermined mailpiece thickness range, said first guide pivoting causes said second guide to be retracted out of the mailpiece transport path.

5. A mailpiece selector device for separating mailpieces one-by-one from a stack of mailpieces and for transporting them-downstream, wherein said mailpiece selector device comprises:

a first guide followed by a second guide, the first guide having a downstream end; and a plurality of opposite selector rollers cooperating with said first and second guides to select said mailpieces one-by-one and to transport them downstream, said first guide being adapted to pivot about a first pivot axis in opposition to first resilient return means, said second guide being adapted to pivot about a second pivot axis in opposition to second resilient return means, and said second pivot axis being offset upstream relative to said first pivot axis, and said first and second guides having drive means adapted to automatically pivot said second guide with said first guide when said downstream end of said first guide pivots a distance above a predetermined mailpiece thickness range, wherein said first guide is comb-shaped, each of the teeth of the comb having an elastomer blade or a ceramic finger fastened to each tooth.

6. A mailpiece feeder for a franking machine, which feeder includes a mailpiece selection device according to claim 5.

7. A mailpiece selector device according to claim 5, wherein the offset of said pivot axes is adapted so that, below said predetermined mailpiece thickness range, said first guide pivoting does not cause said second guide to pivot at all.

8. A mailpiece selector device according to claim 5, wherein the offset of said pivot axes is adapted so that, above a predetermined mailpiece thickness range, said first guide pivoting causes said second guide to be retracted out of the mailpiece transport path.

* * * * *